United States Patent [19]

Brockhaus

[11] Patent Number: 4,854,009

[45] Date of Patent: Aug. 8, 1989

[54] UNHINGEABLE DOOR HINGE FOR MOTOR VEHICLE DOORS HAVING A HINGE PIN DIVIDED INTO TWO BOLT-LIKE HALVES NON ROTATABLY FASTENED TO A HINGE PORTION

[75] Inventor: Ernst Brockhaus, Remscheid-Hasten, Fed. Rep. of Germany

[73] Assignee: Ed. Scharwächter GmbH & Co. KG., Remscheid, Fed. Rep. of Germany

[21] Appl. No.: 125,557

[22] Filed: Nov. 25, 1987

[30] Foreign Application Priority Data

Dec. 27, 1986 [DE] Fed. Rep. of Germany ..... 3644576

[51] Int. Cl.[4] ..... E05D 7/10

[52] U.S. Cl. ..... 16/263; 16/264; 16/266; 16/273; 16/381

[58] Field of Search ..... 16/260, 261, 262, 263, 16/264, 265, 266, 273, 380, 381, 386, DIG. 40

[56] References Cited

U.S. PATENT DOCUMENTS

| | | | |
|---|---|---|---|
| 3,475,784 | 11/1969 | Foltz | 16/380 |
| 4,353,146 | 10/1982 | Brockhaus | 16/273 X |
| 4,528,718 | 7/1985 | Brockhaus | 16/273 X |
| 4,542,558 | 9/1985 | Brockhaus | 16/263 |

FOREIGN PATENT DOCUMENTS

| | | | |
|---|---|---|---|
| 64488 | 4/1946 | Denmark | 16/262 |
| 1459104 | 11/1968 | Fed. Rep. of Germany | 16/386 |
| 3606813 | 7/1987 | Fed. Rep. of Germany | 16/262 |
| 105113 | of 1916 | United Kingdom | 16/264 |
| 875208 | 8/1961 | United Kingdom | 16/262 |
| 2020347 | 11/1979 | United Kingdom | 16/381 |
| 2147655 | 5/1985 | United Kingdom | 16/381 |

*Primary Examiner*—Fred A. Silverberg
*Attorney, Agent, or Firm*—Toren, McGeady & Associates

[57] ABSTRACT

A removable door hinge for motor vehicle doors including two hinge portions to be fastened to the motor vehicle body and the motor vehicle door, respectively. The hinge portions have eye portions defining eye bores. When the hinge is assembled, the eye portions mesh with each other and a hinge pin extends through the eye bores. The two hinge portions are secured against unintentional separation over the permissible pivoting range of the hinge by means of meshing projections and recesses arranged alternatingly on the hinge portions. The hinge pin is divided into two bolt-like halves which are each non-rotatably fastened in an eye portion of one of the hinge portions. A recess serving for the hinge against unintentional separation is provided in the hinge portion to be fixed to the door immediately adjacent the upper eye portion of this hinge portion.

21 Claims, 4 Drawing Sheets

UNHINGEABLE DOOR HINGE FOR MOTOR VEHICLE DOORS HAVING A HINGE PIN DIVIDED INTO TWO BOLT-LIKE HALVES NON ROTATABLY FASTENED TO A HINGE PORTION

BACKGROUND OF THE INVENTION

1. Field of the Invention

The present invention relates to a removable door hinge for motor vehicle doors. The door hinge includes two hinge portions to be fastened to one of the structural parts of the door. The hinge portions have eye portions defining eye bores. When the hinge is assembled, the eye portions mesh with each other and a hinge pin extends through the eye bores. The two hinge portions are secured against unintentional separation over the permissible pivoting range of the hinge by means of meshing projections and recesses arranged alternatingly on the hinge portions.

2. Description of the Prior Art

In modern automobile construction, for reasons of efficiency the doors of a motor vehicle are fitted into the unfinished vehicle body. For this purpose, the two portions of the door hinges must be permanently fastened to the door and to the vehicle body in order to ensure an immovably adjusted position of the vehicle door within the motor vehicle body. However, during the further assembly of the motor vehicle, it is a disadvantage if the vehicle doors remain in the vehicle body.

Accordingly, removable door hinges are used to an increasing extent, so that the doors can be mounted in the unfinished motor vehicle body in a fixedly adjusted position, while the doors are removed from the vehicle body during the assembly of the motor vehicle and particularly the assembly of the interior fittings of the vehicle The doors are then reinstalled on the vehicle body during the final assembly of the motor vehicle. A number of different structural types of removable door hinges are known for this purpose.

In accordance with a first type of movable door hinge, the hinge portions can be separated by removing the hinge portions and can be reassembled by reinserting the hinge pin. Even though this type of construction does not require a special means for securing against unintentional separation, this door hinge is disadvantageous because of the large weight of finished motor vehicle doors which means that it is difficult to reinstall the door on the finished vehicle body.

In accordance with another type of removable door hinge for motor vehicle doors, a hinge pin permanently mounted on one of the hinge portions with running fit and without maintenance, can be inserted into an eye bore of the other hinge portion. In the assembled hinge, the two hinge portions are secured over the pivoting range of the hinge against unintentional separation by means of projections and recesses alternatingly provided in the two hinge portions. In this type of removable hinge, for reinstalling the vehicle door the hinge pin must be placed in non-rotational engagement with the hinge eye of the removable hinge portion. This type of construction is disadvantageous with respect to the configuration of the hinge eye bore and of the hinge pin and with respect to the insertion procedure of the relatively long hinge pin. In addition, since a vehicle door is relatively heavy and the relatively long hinge pins are spaced apart a comparatively greater distance from each other, it is difficult to bring into reliable engagement the members used for the non-rotational fixing of the hinge pin in the removable hinge portion.

It is, therefore, the primary object of the present invention to provide a removable door hinge for motor vehicle doors which is constructed and manufactured with as few precision parts as possible. In addition, the hinge is to enable a manipulation of the vehicle door during removal and reinstallation which is easy and not time-consuming. Moreover, a maintenance-free support of the hinge pin is to be provided without the separability of the two hinge portions resulting in the danger of a damage to the maintenance-free support.

SUMMARY OF THE INVENTION

In accordance with the present invention, the removable door hinge of the type described above includes a hinge pin which is divided into two bolt-like halves which are each non-rotatably fastened in an eye portion of one of the hinge portions. A recess forming part of the means for securing the hinge against unintentional separation is provided in the hinge portion to be fixed to the door immediately adjacent the upper eye portion of this hinge portion.

Since the hinge pin is divided into two bolt-like halves which are non-rotatably connected to the eye portions of one of the hinge portions, the portions of the hinge pin halves which form the pivot bearing of the hinge can have a very short length. As a result, the reinstallment of the vehicle doors can be carried out easily even if, for obtaining a maintenance-free support, the hinge eye bores of the removable hinge portions are aligned with bearing bushings of maintenance-free bearing material.

The short length of the portions of the hinge pin halves forming the bearing particularly means that there is no danger that the bearing bushings of maintenance-free bearing material in the eye bores of the other hinge portion can be damaged. The arrangement of bearing bushings of maintenance-free bearing material in the bores of the removable hinge portion provides the additional advantage that the bearing bushings and the hinge pin halves in the other hinge portion can be permanently preassembled. This preassembly of the bearing bushing and of the hinge pin halves can be carried out in a single automatic machine operation.

In order to protect the bearing bushings permanently against unilateral loads from the hinge halves resulting from the weight of the door, a feature of the present invention provides that a recess in the hinge portion attached to the vehicle door forming part of the means for securing the hinge against unintentional separation is located in alignment along a straight line with the cut which defines the upper eye portion of this hinge portion. As a result, any substantial tilting forces can be absorbed mechanically by the means for securing the hinge against unintentional separation of the hinge portions. In addition, no loads which would result in material deformation act on the linings of the hinge eyes formed by the bearing bushings of maintenance-free material.

The present invention can be realized in several different embodiments, as described below.

In accordance with a feature of the present invention, one of the two halves of the hinge pin is non-rotatably secured by means of an axially directed knurled surface in the eye bore of the respective eye portion of one of the hinge portions. Moreover, adjacent the portion of the hinge pin extending within the eye portion of the hinge portion, each hinge pin half has a radially projecting collar which serves to additionally support the hinge pin half in tilting direction against the surface of the respective eye portion.

In accordance with a first embodiment of the invention, the hinge pin halves can be non-rotatably secured in the eye bores of the eye portions of one of the hinge portions by means of an axially directed knurled surface. However, any other non-rotatable fixing of the two bolt-like hinge pin halves in the eye bores of the hinge portion can be provided. For example, the hinge pin halves may be secured in the hinge eye bores of one of the hinge portions by means of prepared pins or the like or by means of axially acting clamping elements. This has the advantage that, when the door is to be removed, the hinge pin halves can remain in those hinge eyes in which they are seated with running fit. Accordingly, the bearing bushings cannot be damaged during removal and reinstallation of the doors.

In accordance with a further development of the hinge according to the present invention, one of the bolt-like halves of the hinge pin can be non-rotatably secured in the eye bore of the respective eye portion by means a conical portion adjacent the radially projecting collar and by means of an axially engaging clamping screw which rests against the outwardly facing surface of the eye portion. In the pair of hinges used for a vehicle door, this type of securing of the hinge pin halves is arranged either at the inwardly facing or at the outwardly facing pair of eye portions of each hinge.

In accordance with another feature of the present invention, in addition to a first means for securing the hinge against unintentional separation of the type described above, a second securing means is provided.

The second means for securing the hinge against unintentional separation is formed by a securing element which is in releasable positive engagement with the half of the hinge pin assigned to the upper pair of eye portions. This second securing means can also be formed by a ring member which is received in a circumferential groove in the bearing pin portion of one of the hinge pin halves and rests against the outwardly facing surface of the eye portion of the removable hinge portion. The second securing means may also be formed by a screw bolt which is screwed into an axially directed threaded bore in the bearing pin portion of the hinge pin half and rests against the outwardly facing surface of the upper eye portion of the removable hinge pin portion.

In a hinge in which the two hinge pin halves are non-rotatably received in the hinge portion attached to the vehicle body, it is also possible to assign the second securing means to the half of the hinge pin which interacts with the lower pair of eye portions.

In view of the fact that the relatively small free space available for removing and reinstalling the motor vehicle door is definitely defined by the structural dimensions of the vehicle door and of the door opening in the vehicle body as well as by the location and arrangement of the hinges, it is within the scope of the invention that the two bolt-like halves of the hinge pins are rotatably secured to the hinge portion to be attached to the vehicle body. However, the advantages obtained by removable door hinge according to the present invention are not diminished if the arrangement of the non-rotatable fixing of the hinge pin halves is reversed.

The various features of novelty which characterize the invention are pointed out with particularity in the claims annexed to and forming a part of this disclosure. For a better understanding of the invention, its operating advantages and specific objects attained by its use, reference should be had to the drawings and descriptive matter in which there are illustrated and described preferred embodiments of the invention.

DETAILED DESCRIPTION OF THE INVENTION

Figure 1:
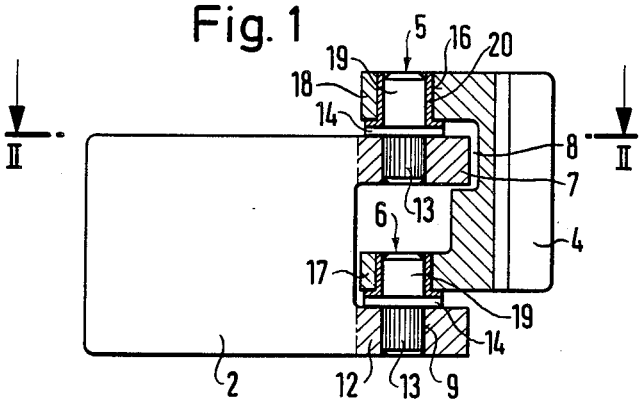
FIG. 1 is a side view, partially in section, of a removable door hinge according to the present invention.

As illustrated in the drawing, a removable door hinge according to the present invention includes in all embodiments a hinge portion 2 to be attached to the motor vehicle 1 and a portion 4 to be attached to the door 3. The hinge further includes two hinge pin halves 5 and 6 and a first means for securing the hinge against unintentional separation formed by a projection 7 in hinge portion 2 and a recess 8 in the other hinge portion 4. This securing means is effective over the permissible pivoting range of the hinge.

Figure 2:
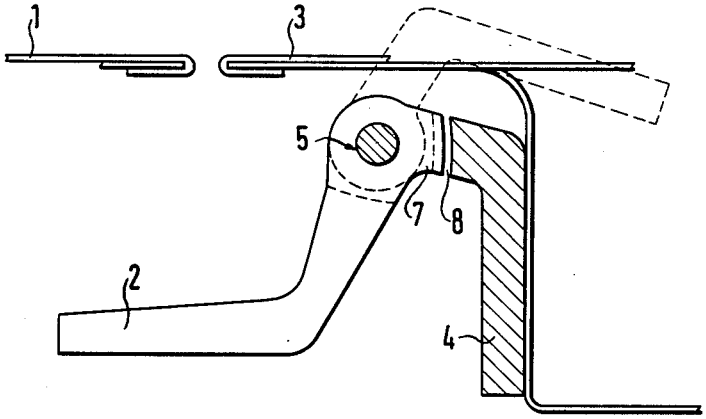
FIG. 2 is a top view of the door hinge of FIG. 1.
Figure 3:
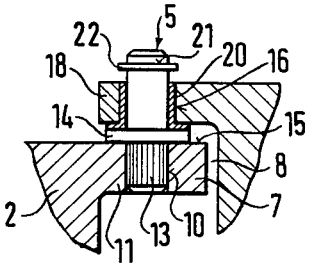
FIG. 3 is a partial side view of another embodiment of the removable door hinge according to the present invention.

In the embodiment illustrated in FIGS. 1 to 3, the two hinge pins 5 and 6 are non-rotatably secured by means of an axially directed knurled surface 13 in eye bores 9 and 10 of eye portions 11 and 12 of the hinge portion 2 to be attached to the motor vehicle body. Adjacent to portion 13, the hinge pin halves 5 and 6 each have a radially projecting collar 14 which serves to additionally support the hinge pin halves 5 and 6 against the respective surface 15 of the eye portions 11 and 12.

Along portions of the hinge pin halves forming bearing bushings 19, the hinge pin halves 5 and 6 are received through a bearing bushing 20 of maintenance-free bearing material in the hinge eye bores 16 of the eye portions 17 and 18 of the hinge portion 4 to be attached to the vehicle door 3. The bearing bushing 20 may be a collared bushing.

In the further development shown in FIG. 3, the bearing pin 19 of the upper hinge pin half 5 for the upper pair of eye portions 11 and 18 is provided with an additional releasable means securing the hinge against unintentional separation in the form of a ring member 22 received in a radial groove 21 of bearing pin 19.

Figure 4:
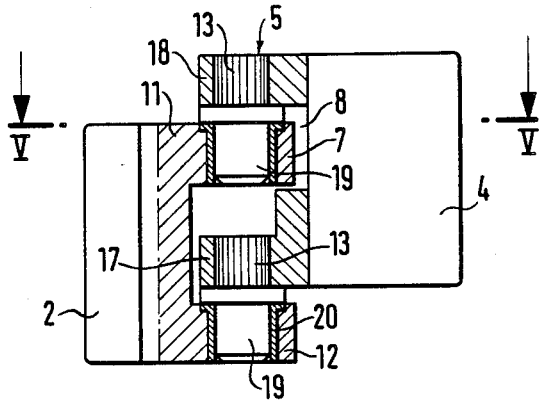
FIG. 4 is a side view, partially in section, of another embodiment of the removable door hinge.
Figure 5:
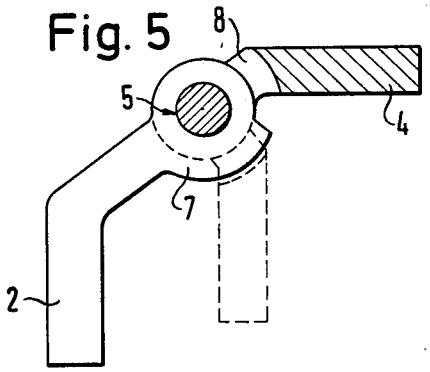
FIG. 5 is a copy of the door hinge of FIG. 4.
Figure 6:
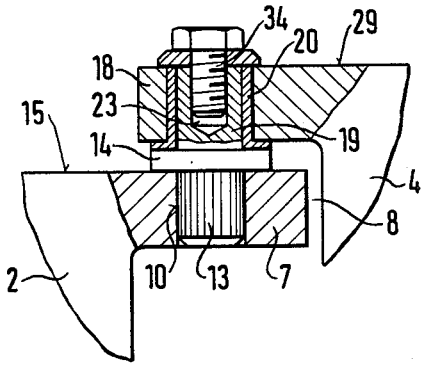
FIG. 6 is a partial side view, on a larger scale, of a variation of the removable door hinge of FIG. 4.

In the embodiment illustrated in FIG. 6, the additional securing means is formed by a screw 34 which can be screwed into an axial bore 22 of bearing pin 19 and rests against the outwardly facing surface of the upper eye portion 18. In the embodiment illustrated in FIGS. 4 and 5, the two hinge pin halves 5 and 6 are non-rotatably supported in the eye portions 17 and 18 of the hinge portion 4 to be attached to the vehicle door 3 by means of a knurled surface 13. The hinge pin halves 5 and 6 engage with bearing pins 19, with the intermediate arrangement of bearing bushings 20 of maintenance-free bearing material, in eye bores in the eye portions 11 and 12 of the hinge portion 2 to be fastened to the motor vehicle body 1.

Figure 7:
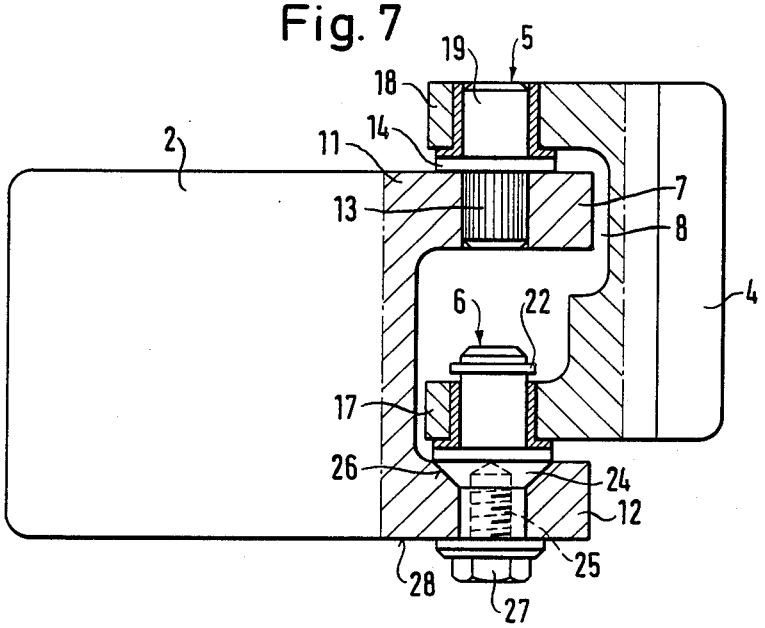
FIG. 7 is a side view, partially in section, of an upper removable door hinge.

In the embodiment illustrated in FIG. 7, the hinge pin half 5 for the upper pair of eye portions 11 and 14 of the two hinge portions 2 and 4 is non-rotatably secured in an eye bore 10 of eye portion 11 of the hinge portion 2 to be attached to the motor vehicle body 1 by means of an axially directed knurled surface 13. Hinge pin half 5 engages into the hinge eye bore 11 of eye portion 14 of the hinge portion 4 to be attached to the door by means of a bearing bushing 20 of maintenance-free material. The lower half 6 of the hinge pin engages along end portion 19 by means of a bearing bushing of maintenance-free material 20 to an eye bore 16 of eye portion 17.

The lower half 6 of the hinge pin is non-rotatably secured in the eye portion 12 of hinge portion 2 to be fastened to the motor vehicle body 1 by means of a conical portion 24 and in axially directed clamping screw 25. Conical portion 24 engages in a corresponding conical widening portion 26 of hinge eye bore 9 and head 27 of clamping screw 25 rests against the outwardly facing surface 28 of eye portion 12.

Figure 8:
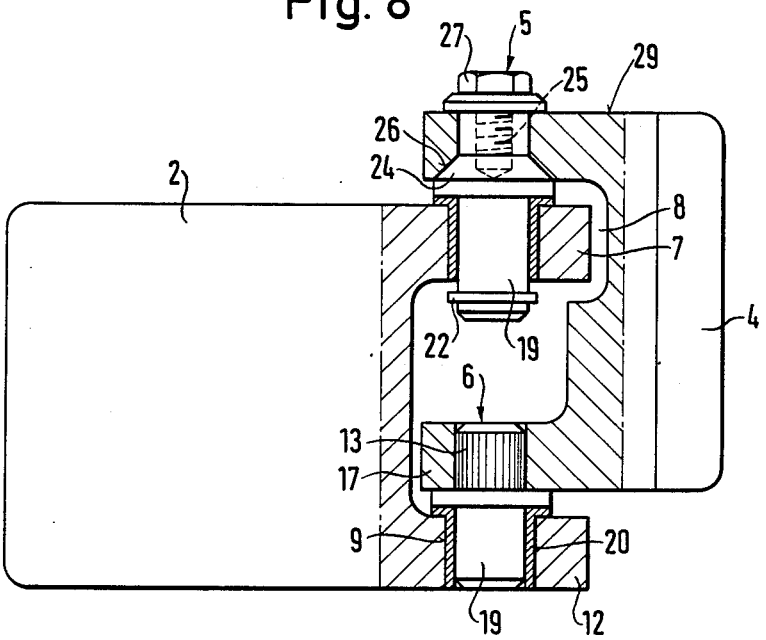
FIG. 8 is a side view, partially in section, of a lower removable door hinge.

In the embodiment illustrated in FIG. 8, the lower half 6 of the hinge pin is secured in the eye bore 16 of the lower portion 17 of the hinge portion 4 to be fastened to the vehicle door 3 by means of an axially directed knurled surface 13 and engages with the intermediate arrangement of a bearing bushing 20 of maintenance-free bearing material with its bearing pin portion 19 into an eye bore 9 of the lower eye portion of the hinge portion to be fastened to the motor vehicle body 1.

In this case, the upper half 5 of the hinge pin is non-rotatably secured by means of a conical portion 24 and an axially directed clamping screw 25 in the eye bore 16 of the hinge portion 4 to be fastened to the vehicle door. Conical portion 24 interacts with a corresponding conical widening portion 26 of eye bore 16 and head 27 of screw 25 rests against the outer surface 29 of the eye portion 14.

Figure 9:
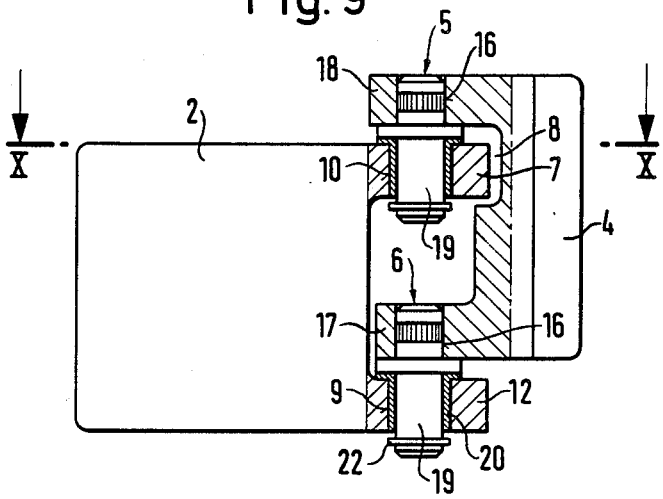
FIG. 9 is a side view, partially in section, of another embodiment of a removable door hinge.
Figure 10:
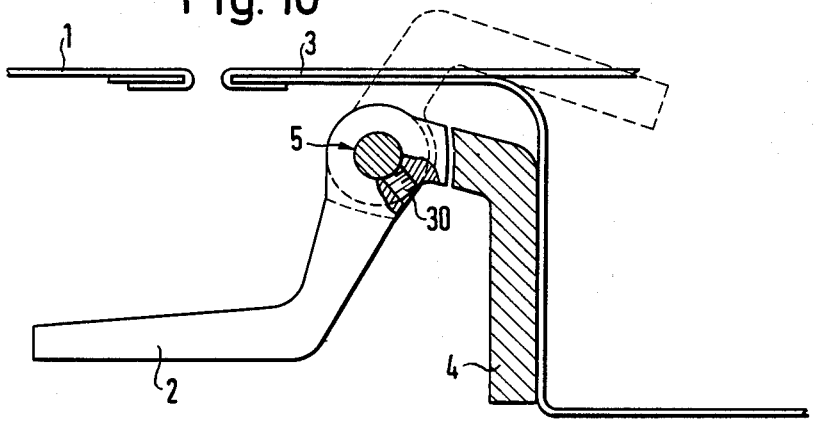
FIG. 10 is a top view of the door hinge of FIG. 9.
Figure 11:
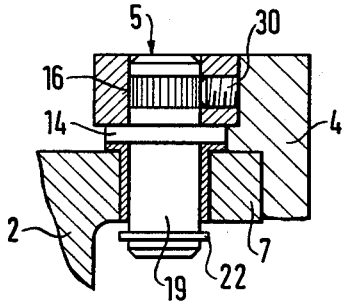
FIG. 11 is a partial side view of the embodiment of FIG. 9.

In the embodiment illustrated in FIGS. 9 and 10, the two halves 5 and 6 of the hinge pin are each received non-rotatably with press fit in the hinge eye bores 16 of the hinge portion 4 to be attached to the vehicle door 3 and engage along the bearing pin portion 19 with the intermediate arrangement of bearing bushings 20 of maintenance-free bearing material in each eye bore 9 and 10 of the hinge portion 2 to be fastened to the motor vehicle body 1. In addition to this press fit arrangement in the hinge eye bores 16 of the hinge portion 4 the hinge pin halves 5 and 6 are secured against rotation in circumferential direction in the eye portions 17 and 18 of hinge portion 4 by means of radially directed headless screws 30.

The door hinges according to the present invention illustrated in FIGS. 7 and 9 include an additional securing means in the form of a ring member engaging a circumferential groove of the bearing pin portions 19 of the lower hinge pin halves. In the door hinge illustrated in FIG. 8, this additional securing means is provided in the upper half 5 of the hinge pin.

While specific embodiments of the invention have been shown and described in detail to illustrate the application of the inventive principles, it will be understood that the invention may be embodied otherwise without departing from such principles.

I claim:

1. A removable door hinge for motor vehicle doors, the door hinge including two hinge portions, one of the hinge portions adapted for being fastened to a structural part of a motor vehicle door and the other hinge portion adapted for being fastened to a motor vehicle body, each hinge portion having upper and lower eye portions defining eye bores, the eye portions meshing with each other in the assembled state of the hinge and a hinge pin extending through the eye bores, means for securing the hinge against unintentional separation over a permissible pivoting range of the hinge, the securing means being formed by meshing at least one projection and at least one recess arranged alternatingly on the hinge portions, the improvement comprising that the hinge pin is divided into two bolt-like halves which are each non-rotatably fastened to the eye portions of one of the hinge portions, the recess forming part of the securing means being provided in the hinge portion to be fixed to the motor vehicle door, the recess being located immediately adjacent the upper eye portion of the hinge portion to be fixed to the motor vehicle door.

2. The door hinge according to claim 1, wherein the recess is located in alignment along a straight line with a cut defining the upper eye portion of the hinge portion to be fixed to the vehicle door.

3. The door hinge according to claim 1, the two bolt-like halves of the hinge pin are each received with running fit in the eye portions of the other of the hinge portions in bearing bushings of maintenance-free bearing material.

4. The door hinge according to claim 1, wherein each hinge pin half has a radially projecting collar adjacent a portion of the hinge pin half received in the eye portion.

5. The door hinge according to claim 4, wherein the non-rotatable fastening of one of the hinge pin halves is by means of a conical portion of the hinge pin half adjacent the collar and a clamping screw axially engaging the conical portion, the clamping screw resting against the outwardly facing surface of the eye portion.

6. The door hinge according to claim 5, wherein the fastening by means of conical portion and clamping screw is at the upper eye portion.

7. The door hinge according to claim 5, wherein the fastening by means of conical portion and clamping screw is at the lower eye portion.

8. The door hinge according to claim 5, wherein, in a pair of hinges used for a vehicle door, the fastening by means of conical portion and clamping screw is provided at the inwardly facing pair of eye portions of each hinge.

9. The door hinge according to claim 5, wherein, in a pair of hinges used for a vehicle door, the fastening by means of conical portion and clamping screw is provided at the outwardly facing pair of eye portions of each hinge.

10. The door hinge according to claim 1, wherein the non-rotatable fastening of at least one of the hinge pin halves is by means of an axially directed knurled surface on the hinge pin half.

11. The door hinge according to claim 1, wherein the non-rotatable fastening of the two hinge pin halves is by means of axially directed knurled surfaces of the hinge pin halves.

12. The door hinge according to claim 1, wherein the two hinge pin halves are non-rotatably fastened to the hinge portion to be fixed to the vehicle door.

13. The door hinge according to claim 1, wherein the two hinge pin halves are non-rotatably fastened to the hinge portion to be fixed to the vehicle body.

14. The door hinge according to claim 1, wherein the non-rotatable fastening of the hinge pin halves is by means of pins extending transversely through the hinge pin halves.

15. The door hinge according to claim 1, wherein the non-rotatable fastening of the hinge pin halves is by means of clamping elements acting in axial direction of the hinge pin halves.

16. The door hinge according to claim 1, comprising another means for securing the hinge against unintentional separation, the another securing means being a securing element in releasable positive engagement with the upper eye portions.

17. The door hinge according to claim 16, wherein the securing element is a ring member engaging a circumferential groove in the bearing pin half.

18. The door hinge according to claim 16, wherein the securing element is a screw bolt screwed into an axially directed threaded bore in a portion of the bearing pin half extending along the eye bore.

19. The door hinge according to claim 1, comprising another means for securing the hinge against unintentional separation, the another securing means being a securing element in releasable positive engagement with the lower eye portions.

20. The door hinge according to claim 19, wherein the securing element is a ring member engaging a circumferential groove in the bearing pin half.

21. The door hinge according to claim 19, wherein the securing element is a screw bolt screwed into an axially directed threaded bore in a portion of the bearing pin half extending along the eye bore.

* * * * *